US009052647B2

(12) United States Patent
Ohba

(10) Patent No.: US 9,052,647 B2
(45) Date of Patent: Jun. 9, 2015

(54) IMAGE FORMING APPARATUS INCLUDING TRANSFER ROLLER AND TRANSFER BIAS APPLYING SECTION

(71) Applicant: KYOCERA Document Solutions Inc., Osaka (JP)

(72) Inventor: Keisuke Ohba, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 9 days.

(21) Appl. No.: 13/903,843

(22) Filed: May 28, 2013

(65) Prior Publication Data

US 2013/0322905 A1 Dec. 5, 2013

(30) Foreign Application Priority Data

May 30, 2012 (JP) ..... 2012-123505

(51) Int. Cl.
*G03G 15/16* (2006.01)
*G03G 15/23* (2006.01)

(52) U.S. Cl.
CPC ..... *G03G 15/1675* (2013.01); *G03G 15/231* (2013.01)

(58) Field of Classification Search
CPC ..... G03G 15/1675
USPC ..... 399/66
See application file for complete search history.

(56) References Cited

U.S. PATENT DOCUMENTS

2010/0329715 A1* 12/2010 Tsukamura et al. ..... 399/66

FOREIGN PATENT DOCUMENTS

| | | | |
|---|---|---|---|
| JP | 09-114273 | A | 5/1997 |
| JP | 2007-156196 | A | 6/2007 |
| JP | 2012-032573 | A | 2/2012 |

OTHER PUBLICATIONS

Notice of Rejection mailed by Japan Patent Office on Jun. 17, 2014 in the corresponding Japanese patent application No. 2012-123505—3 pages.

* cited by examiner

*Primary Examiner* — Hoang Ngo
(74) *Attorney, Agent, or Firm* — Knobbe, Martens, Olson & Bear LLP

(57) ABSTRACT

An image forming apparatus includes a photosensitive drum, a charging section, an exposure section, a developing section, an ion-conductive transfer roller, a transfer bias applying section configured to apply a transfer bias of reverse polarity to charge of toner to the transfer roller, a conveyance section, and a control section. The control section is configured to, during double-sided printing, cause the transfer bias applying section to apply a reverse bias of the same polarity as the charge of the toner to the transfer roller while a recording medium is reversed and conveyed again to a toner image transfer position.

6 Claims, 8 Drawing Sheets

IMAGE FORMING APPARATUS INCLUDING TRANSFER ROLLER AND TRANSFER BIAS APPLYING SECTION

INCORPORATION BY REFERENCE

This application claims priority to Japanese Patent Application No. 2012-123505 filed on May 30, 2012, the entire contents of which are incorporated by reference herein.

BACKGROUND

The present disclosure relates to image forming apparatuses and particularly relates to control of the application of bias to a transfer roller.

In recent electrophotographic image forming apparatuses, a toner image formed on the surface of a photosensitive drum is transferred to a recording medium by a transfer roller. In this transfer, a transfer bias applying section applies to the transfer roller a transfer bias of reverse polarity to the charge of toner forming the toner image to be transferred. If the transfer roller is an ion-conductive transfer roller, continued application of the above transfer bias from the transfer bias applying section will cause ionic polarization inside the transfer roller to impair the electric conduction. To cope with this, for example, in a known image forming apparatus, a reverse bias of the same polarity as toner charge is applied from its transfer bias applying section to its transfer roller with the timing of completion of image formation and the timing of an interval between recording paper sheets being successively conveyed, thereby reducing ionic polarization and thus preventing the deterioration (resistance rise) of the transfer roller.

However, if, in the case of using an ion-conductive roller as the transfer roller, a reverse bias is applied thereto in an interval between recording paper sheets as described above, ionic polarization can be avoided to prevent the deterioration of the transfer roller but a history of charge due to the application of the reverse bias remains on the surface of the photosensitive drum. As a result, the toner image formed on the surface of the photosensitive drum causes concentration differences between various portions thereof. Therefore, in the case of using an ion-conductive roller as the transfer roller, a normal bias has had to be continuously applied to the transfer roller for all the intervals between recording paper sheets during continuous printing. To reduce the above ionic polarization and prevent the above deterioration of the transfer roller, it has been necessary to secure enough time for post-aging after the completion of printing.

SUMMARY

The present disclosure is designed to solve the above problem and, therefore, an object thereof is that in transferring a toner image on the surface of a photosensitive drum to a recording medium using an transfer roller, the effect of reducing ionic polarization and thus preventing the deterioration of the transfer roller is preserved and concurrently the time for post-aging is reduced.

Specifically, an image forming apparatus according to one aspect of the present disclosure includes a photosensitive drum, a charging section, an exposure section, a developing section, a transfer roller, a transfer bias applying section, a conveyance section, and a control section.

The photosensitive drum has a surface on which an electrostatic latent image is formed while the surface rotates in a circumferential direction of the photosensitive drum.

The charging section is configured to charge the surface of the photosensitive drum.

The exposure section is configured to irradiate the surface of the photosensitive drum charged by the charging section with light to form the electrostatic latent image.

The developing section is configured to supply toner to the electrostatic latent image formed on the surface of the photosensitive drum by the exposure section to form a toner image.

The transfer roller is an ion-conductive transfer roller configured to transfer the toner image from the surface of the photosensitive drum to a recording medium using a transfer bias.

The transfer bias applying section is configured to apply to the transfer roller the transfer bias of reverse polarity to charge of the toner forming the toner image.

The conveyance section is configured to, during single-sided printing, successively convey a plurality of the recording media to a toner image transfer position for transfer of the toner image located between the photosensitive drum and the transfer roller and, during double-sided printing, successively convey a plurality of the recording media by reversing the recording medium having once passed through the toner image transfer position and conveying the reversed recording medium to the toner image transfer position again.

The control section is configured to, in the case of causing the conveyance section to convey the recording medium during double-sided printing, cause the transfer bias applying section to apply the transfer bias to the transfer roller while the recording medium passes through the toner image transfer position and then cause the transfer bias applying section to apply a reverse bias of the same polarity as the charge of the toner to the transfer roller during a period from the time when the recording medium has passed through the toner image transfer position to the time when the recording medium is conveyed again to the toner image transfer position after being reversed.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
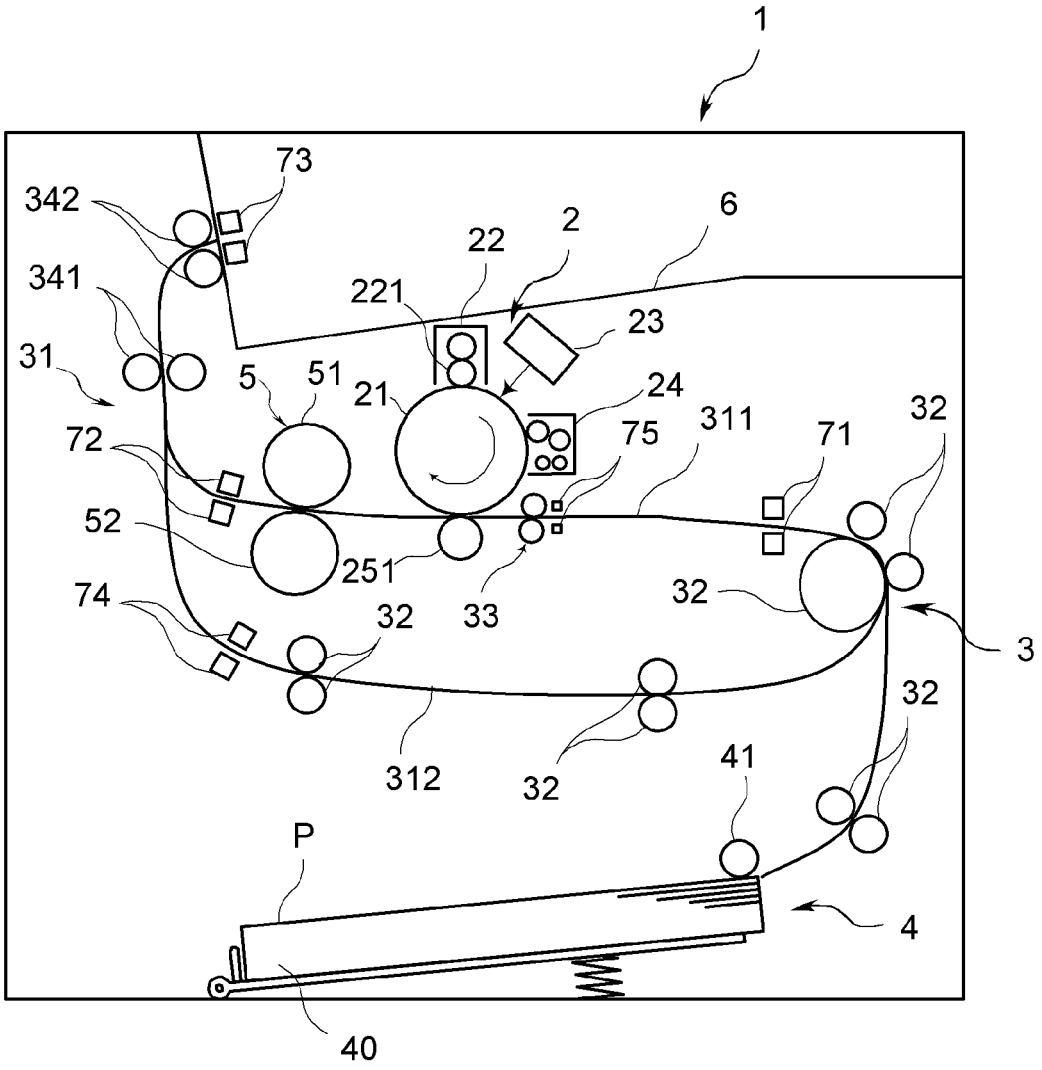
FIG. 1 is a side view showing a schematic mechanical structure of an image forming apparatus according to one embodiment of the present disclosure.

Hereinafter, a description will be given of an image forming apparatus 1 according to one embodiment of the present disclosure with reference to the drawings. FIG. 1 is a side view showing a schematic mechanical structure of the image forming apparatus 1 according to the one embodiment of the present disclosure.

The image forming apparatus 1 includes an image forming section 2, a conveyance section 3, a paper feed mechanism 4, a fixing section 5, and a paper output tray 6. This embodiment describes, as an example, the case where the image forming apparatus 1 is a printer.

The image forming section 2 performs an image forming operation for forming a toner image on a recording paper sheet P (an example of a recording medium) conveyed from the paper feed mechanism 4 by the conveyance section 3. The image forming section 2 includes a photosensitive drum 21, a charging section 22, an exposure section 23, a developing section 24, and a transfer roller 251.

The surface of the photosensitive drum 21 is provided with a photosensitive layer. The photosensitive drum 21 is configured so that when charged by the charging section 22, the surface potential thereof reaches a predetermined value. This embodiment describes, as an example, the case where the photosensitive drum 21 is formed of an organic photoconductor and the photosensitive layer forming the surface is composed of a single layer. However, the photosensitive drum to be applied is not limited to this.

The charging section 22 is disposed at a position facing the surface of the photosensitive drum 21. The charging section 22 substantially uniformly charges, with a predetermined charging power, the peripheral surface of the photosensitive drum 21 rotating in the direction of the arrow showing in FIG. 1. This embodiment describes, as an example, the case where the charging section 22 includes a charging roller 221 in contact with the surface of the photosensitive drum 21 and the charging roller positively charges the surface of the photosensitive drum 21. However, the charging section to be applied is not limited to this.

The exposure section 23 is disposed at a position facing the surface of the photosensitive drum 21 and downstream of the charging section 22 in the direction of rotation of the peripheral surface of the photosensitive drum 21. The exposure section 23 irradiates the charged peripheral surface of the photosensitive drum 21 with laser light shown by the arrow in FIG. 1 and corresponding to image data or the like input from a computer (not shown) or the like connected to the image forming apparatus 1 with a network, thereby forming an electrostatic latent image corresponding to the image data on the peripheral surface of the photosensitive drum 21. The exposure section 23 is a laser exposure section and includes: a laser light source (not shown) capable of outputting a laser beam; a polygon mirror (not shown) capable of reflecting the laser beam toward the surface of the photosensitive drum 21; and optical elements, such as a lens (not shown) and a mirror (not shown), for introducing the laser light reflected by the polygon mirror to the photosensitive drum 21. The exposure section 23 may be formed of a different system, such as a system that irradiates the surface of the photosensitive drum 21 with light by means of an LED (light emitting diode).

The developing section 24 supplies toner (not shown) to the electrostatic latent image formed on the surface of the photosensitive drum 21 by the exposure section 23. Upon the toner supply of the developing section 24, the toner is deposited on the electrostatic latent image located in the region of the surface of the photosensitive drum 21 exposed to light by the exposure section 23, resulting in the formation of a toner image corresponding to the electrostatic latent image. The toner is supplied to the developing section 24 from an unshown toner container.

The transfer roller 251 is an ion-conductive roller and is disposed at a position facing the photosensitive drum 21 and downstream of the developing section 24 in the direction of rotation of the photosensitive drum 21. A transfer bias of reverse polarity to that of the toner is applied to the transfer roller 251 by a transfer bias applying section (see FIG. 2), so that the transfer roller 251 transfers the toner image formed on the surface of the photosensitive drum 21 to a recording paper sheet P conveyed to a position (toner image transfer position) between the surface of the photosensitive drum 21 and the surface of the transfer roller 251. Then, during post-aging to be described later and/or other situations, a reverse bias (a bias of the same polarity as that of the toner) is applied to the transfer roller 251 by the control section 10 and the transfer bias applying section (see FIG. 2).

The fixing section 5 is disposed downstream of the toner image transfer position of the image forming section 2 in the direction of conveyance of the recording paper sheet P and configured to fix the toner image, which has been transferred to the recording paper sheet P having passed through the image forming section 2, on the recording paper sheet P by thermal fusion using a heat roller 51 and a pressure roller 52.

A paper conveyance mechanism (conveyance section) 3 includes a paper conveyance path 31, conveyance roller pairs 32, a registration roller pair 33, and switchback roller pairs 341, 342. The conveyance roller pairs 32, the registration roller pair 33, and the switchback roller pairs 341, 342 are driven into rotation by a rotary drive force supplied from a main drive motor 9.

The paper conveyance path 31 is a conveyance path along which recording paper sheets P are conveyed from the paper feed mechanism 4 through the image forming section 2 and the fixing section 5 to the paper output tray 6. The conveyance roller pairs 32 are disposed at some points of the paper conveyance path 31. By the rotation and nipping of each of the conveyance roller pairs 32, the recording paper sheet P is conveyed in the paper conveyance path 31 from the paper feed mechanism 4 to the image forming section 2, then to the fixing section 5, and finally to the paper output tray 6.

Furthermore, the paper conveyance path 31 includes a main conveyance path 311 and a reverse conveyance path 312. The main conveyance path 311 is a conveyance path connecting the paper feed mechanism 4 via the image forming section 2 and the fixing section 5 to the paper output tray 6. The reverse conveyance path 312 is a conveyance path for use during double-sided printing to convey the recording paper sheet P on one side of which an image has been formed in the image forming section 2 to the image forming section 2 again for the purpose of printing on the other side. The reverse conveyance path 312 branches off from the main conveyance path 311 at a bifurcation downstream of the fixing section 5 in the direction of conveyance of the recording paper sheet P and joins the main conveyance path 311 at a junction downstream of the paper feed mechanism 4 in the direction of conveyance of the recording paper sheet P and upstream of the image forming section 2 in the same direction.

The switchback roller pairs 341, 342 are disposed in the main conveyance path 311 between the downstream side of the fixing section 5 in the direction of conveyance of the recording paper sheet P and the paper output tray 6. The switchback roller pairs 341, 342 convey, under the control exercised by a control section 10 (see FIG. 2) to be described later, the recording paper sheet P between the fixing section 5 and the paper output tray 6. When outputting the recording paper sheet P having passed through the image forming section 2 and the fixing section 5 to the paper output tray 6, the switchback roller pairs 341, 342 convey the recording paper sheet P toward the paper output tray 6 until the trailing end of the recording paper sheet P leaves the switchback roller pair 342 located downstream of the other 341 in the direction of conveyance of the recording paper sheet P.

On the other hand, when conveying the recording paper sheet P having passed though the image forming section 2 and the fixing section 5 to the image forming section 2 again for the purpose of double-sided printing, the switchback roller pairs 341, 342 convey the recording paper sheet P having passed through the fixing section 5, first toward the paper output tray 6. Then, when the trailing end of the recording paper sheet P in the direction of conveyance thereof leaves the switchback roller pair 341 located upstream of the other 342 in the direction of conveyance of the recording paper sheet P and the recording paper sheet P is nipped by the switchback roller pair 342 located downstream of the other 341 in the direction of conveyance of the recording paper sheet P, the switchback roller pairs 341, 342 are reversely rotated by the control exercised by the control section 10. At this time, an unshown conveyance path switch mechanism provided at the bifurcation between the main conveyance path 311 and the reverse conveyance path 312 guides the recording paper sheet P to the reverse conveyance path 312. Thus, the recording paper sheet P reversely conveyed on the main conveyance path 311 by the switchback roller pairs 341, 342 is guided to the reverse conveyance path 312, conveyed to a portion of the main conveyance path 311 upstream of the image forming section 2 in the direction of conveyance of the recording paper sheet P, and then conveyed again (re-conveyed) to the image forming section 2. During this re-conveyance, the reversing operation of the switchback roller pairs 341, 342 and the operation of conveying the recording paper sheet P on the reverse conveyance path 312 cause the side of the recording paper sheet P opposite to the side thereof having an image already formed thereon to face the photosensitive drum 21. Therefore, this time, the image forming section 2 forms an image on the side of the recording paper sheet P different from the side on which an image has already been formed.

In continuous printing (image formation) on a plurality of recording paper sheets P, in order to increase the printing speed, the interval int1 (sheet interval) between the recording paper sheet P being subjected to image formation and the next recording paper sheet P to be conveyed from a paper feeder 40 is reduced as much as possible based on the speed of image formation and the speed of conveyance of the recording paper sheets. On the other hand, the path on which the recording paper sheet P is conveyed again to the toner image transfer position, i.e., a position at which a toner image is transferred from the photosensitive drum 21 to the recording paper sheet P by the transfer roller 251, by the above reversing operation during double-sided printing is longer than the path from the paper feeder 40 to the toner image transfer position. Therefore, the interval int2 from the passage of the recording paper sheet P through the toner image transfer position for printing on one side thereof to the return of the recording paper sheet P to the toner image transfer position resulting from the above reversing operation is longer in time than the interval int1.

The registration roller pair 33 is disposed in the conveyance path 311 upstream of the image forming section 2 in the direction of conveyance of the recording paper sheet P. The registration roller pair 33 adjusts the timing to convey the recording paper sheet P being conveyed on the main conveyance path 311 to the position where the photosensitive drum 21 and the transfer roller 251 face each other, i.e., the toner image transfer position in the image forming section 2.

In addition, paper detecting sensors 71, 72, 73, 74 are provided at various points of the paper conveyance path 31. Each of the paper detecting sensors 71, 72, 73, 74 is formed of, for example, an optical sensor including a light-emitting part and a light-receiving part disposed facing each other with the paper conveyance path 31 therebetween. While the light-receiving part receives light from the light-emitting part, the paper detecting sensor outputs to the control section 10 a paper absence signal indicating that no recording paper sheet P exists at the position where the paper detecting sensor is disposed. On the other hand, while a recording paper sheet P exists between the light-emitting part and light-receiving part and thus the light-receiving part does not receive light from the light-emitting part, the paper detecting sensors 71, 72, 73, 74 outputs to the control section 10 a paper presence signal indicating that the recording paper sheet P exists at the position where the paper detecting sensor is disposed.

Furthermore, the control section 10 detects a point of time when the detection signal received from each paper detecting sensor has changed from a paper absence signal to a paper presence signal as a point of time when the leading end of the recording paper sheet P has reached the paper detecting sensor. The control section 10 detects a point of time when the detection signal received from the paper detecting sensor has changed from the paper presence signal to a paper absence signal as a point of time when the trailing end of the recording paper sheet P has passed through the paper detecting sensor.

For example, the paper detecting sensor 71 is located in the main conveyance path 311 upstream of the image forming section 2 and the registration roller pair 33 in the direction of conveyance of the recording paper sheet P. The paper detecting sensor 72 is disposed in the main conveyance path 311 downstream of the toner image transfer position and the fixing section 5 in the direction of conveyance of the recording paper sheet P. The paper detecting sensor 73 is disposed at the distal end of the main conveyance path 311 more downstream than the paper detecting sensor 72 in the direction of conveyance of the recording paper sheet P, i.e., at the junction between the main conveyance path 311 and the paper output tray 6. The paper detecting sensor 74 is disposed in the reverse conveyance path 312.

The control section 10 detects a paper jam (a jam of a recording paper sheet P) in the paper conveyance path 31 based on the paper presence signal and paper absence signal acquired from each paper detecting sensor 71, 72, 73, 74.

A registration sensor 75 is disposed in the main conveyance path 311 upstream of the registration roller pair 33 in the direction of conveyance of the recording paper sheet P and downstream of the paper detecting sensor 71 in the direction of conveyance of the recording paper sheet P. The configuration of the registration sensor 75 is the same as that of the paper detecting sensor 71.

The control section 10 makes an adjustment, using the timing when the paper detecting sensor 71 has detected that the leading end of the recording paper sheet P has reached it, to match the timing for the image forming section 2 to transfer the toner image to the recording paper sheet P with the timing when the recording paper sheet P reaches the toner image transfer position so that the recording paper sheet P can be conveyed to the toner image transfer position in the image forming section 2 a predetermined specified time after the timing when the paper detecting sensor 71 has detected that the leading end of the recording paper sheet P has reached it. This timing adjustment of the control section 10 is preformed, such as by controlling the timing when the recording paper sheet P reaches the toner image transfer position in the image forming section 2. The predetermined specified time described above is a time determined based on, for example, the rate of paper conveyance of the registration roller pair 33 and the distance between the registration sensor 75 and the toner image transfer position.

The control section 10 detects, with the timing when the paper detecting sensor 73 has detected that the trailing end of the recording paper sheet P has passed therethrough, that the trailing end of the recording paper sheet P has left the switchback roller pair 342 described above.

The paper feed mechanism 4 is a mechanism to feed recording paper sheets P to the paper conveyance path 31 and includes the paper feeder 40 and a paper feed roller 41. The paper feeder 40 contains a plurality of recording paper sheets P in a stack. The paper feed roller 41 engages against the surface of the uppermost one of the recording paper sheets P contained in the paper feeder 40 and can be rotated to pick up the recording paper sheets P one by one in order from the uppermost one and feed them to the paper conveyance path 31.

Figure 2:
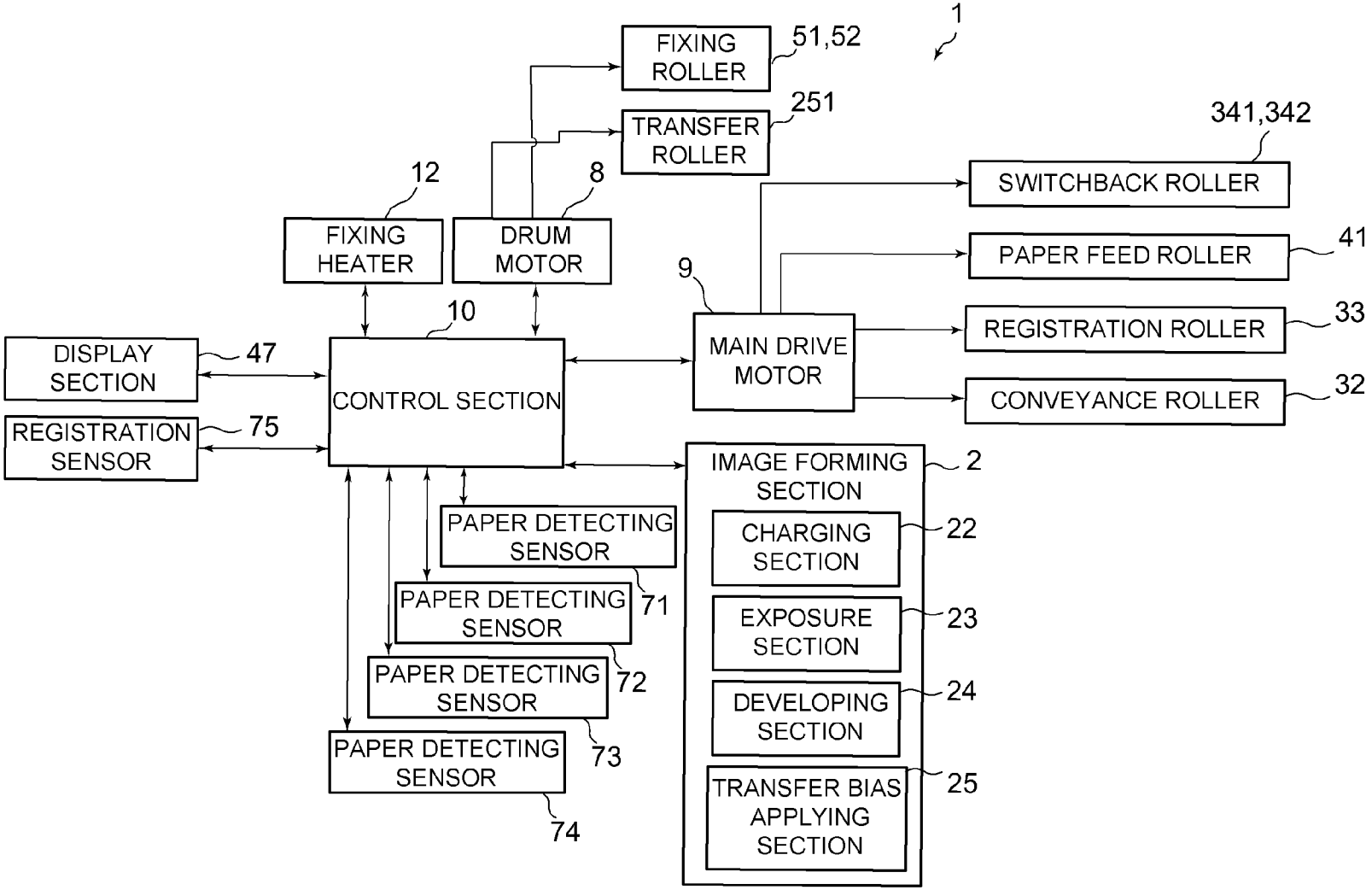
FIG. 2 is a block diagram showing a schematic electrical configuration of the image forming apparatus.

FIG. 2 is a block diagram showing a schematic electrical configuration of the image forming apparatus 1.

First, the schematic electrical configuration of the image forming apparatus 1 is described.

The image forming apparatus 1 includes the control section 10 which governs the overall operation control of the image forming apparatus 1. The control section 10 mainly drives the image forming section 2, a drum motor 8, the main drive motor 9, a fixing heater 12, the registration sensor 75, and a display section 47.

The main drive motor 9 is, as described previously, a drive source for supplying a rotary drive force to the conveyance roller pairs 32, the switchback roller pairs 341, 342, the paper feed roller 41, and the registration roller pair 33.

The drum motor 8 is a drive source for supplying a rotary drive force to a rotating shaft (not shown) of the photosensitive drum 21. In addition, the drum motor 8 also supplies a rotary drive force to the heat roller 51 and the pressure roller 52 in the fixing section 5, the charging roller 221 in the charging section 22, a developing roller 241 in the developing section 24, and the transfer roller 251.

Moreover, the control section 10 controls the drive of the paper detecting sensors 71, 72, 73, 74 and acquires the above-mentioned paper presence signals and paper absence signals from the paper detecting sensors 71, 72, 73, 74. The control section 10 determines, based on a paper presence signal or a paper absence signal acquired from each of the paper detecting sensors 71, 72, 73, 74, whether a paper sheet exists or not at each of the positions where the paper detecting sensors are disposed.

The control section 10 controls the conveyance of the recording paper sheet P, an image forming operation, a fixing operation, and a post-aging operation to be described later, all of which are performed during the formation of an image on the recording paper sheet P. The image forming section 2 further includes a transfer bias applying section 25 configured to apply to the transfer roller 251 a transfer bias of reverse polarity to the charge of the toner forming the toner image.

Next, the operation control during the image formation in the image forming apparatus 1 is described.

In each image forming operation, the control section 10 causes the paper feed roller 41 to pick up one of the recording paper sheets P contained in the paper feeder 40 and feed the picked-up recording paper sheet P to the main conveyance path 311 and causes the conveyance roller pairs 32 disposed at various points of the main conveyance path 311 to convey the recording paper sheet P toward the image forming section 2. In the case of continuous printing for continuously forming images on a plurality of recording paper sheets P, the control section 10 causes the paper feed roller 41 and the conveyance roller pairs 32 to successively convey the plurality of recording paper sheets P toward the image forming section 2.

Using the timing when the paper feed roller 41 has started to convey the recording paper sheet P to the main conveyance path 311, the control section 10 causes the image forming section 2 to start the formation of a toner image for transfer to the recording paper sheet P so that the toner image on the surface of the photosensitive drum 21 can be transferred to the recording paper sheet P a predetermined time after the timing when the paper feed roller 41 has started to convey the recording paper sheet P (wherein the predetermined time is determined based on the rate of paper conveyance of the paper feed roller 41, the conveyance roller pairs 32, and the registration roller pair 33 and the distance between the paper feed mechanism 4 and the toner image transfer position). At this time, the control section 10 drives the image forming section 2 including the drum motor 8, causes the above-mentioned charging section 22 in the image forming section 2 to uniformly charge the surface of the photosensitive drum 21, and causes the exposure section 23 to expose the surface of the photosensitive drum 21 to light by light irradiation to form an electrostatic latent image. Furthermore, the control section 10 causes the developing section 24 to supply positively charged toner from the developing roller 241 to the surface of the photosensitive drum 21. Moreover, the control section 10 causes the transfer bias applying section 25 to apply a transfer bias of reverse polarity to the charge of the toner (negative polarity) to the transfer roller 251.

In addition, using a paper detection signal output by the registration sensor 75 disposed near the position where the registration roller pair 33 is disposed, the control section 10 causes the registration roller pair 33 to adjust the timing when the leading end of the recording paper sheet P reaches the toner image transfer position in the image forming section 2. Thus, timing adjustment is made to match the timing for the image forming section 2 to transfer a toner image to the recording paper sheet P with the timing when the recording paper sheet P reaches the transfer position. For example, the control section 10 makes an adjustment so that the leading end of the recording paper sheet P reaches the toner image transfer position in the image forming section 2 a predetermined specified time after the leading end of the recording paper sheet P has been detected by the registration sensor 75.

The control section 10 causes the toner image on the surface of the photosensitive drum 21 to be transferred, using the transfer bias from the transfer roller 251, to the recording paper sheet P conveyed to the toner image transfer position in the image forming section 2, i.e., between the photosensitive drum 21 and the transfer roller 251, by the registration roller pair 33. The toner image on the photosensitive drum 21 is transferred sequentially to each of the recording paper sheets P successively conveyed to between the photosensitive drum 21 and the transfer roller 251.

The control section 10 causes the recording paper sheet P after the completion of image formation in the image forming section 2 to pass through the fixing section 5 and then causes the switchback roller pairs 341, 342 to output the recording paper sheet P to the paper output tray 6. In the case of double-sided printing, the control section 10 causes the switchback roller pairs 341, 342 to perform the above-mentioned reversing operation to convey the recording paper sheet P via the reverse conveyance path 312 to the toner image transfer position in the image forming section 2 again, causes the image forming section 2 to form an image on the other side of the recording paper sheet P, and causes the conveyance roller pairs 32 and so on to output the recording paper sheet P to the paper output tray 6.

Furthermore, while the recording paper sheets P are conveyed during the image formation, the control section 10 determines, based on a paper presence signal and a paper absence signal from each of the paper detecting sensors 71, 72, 73, 74, whether each recording paper sheet P has reached each of the positions of the paper detecting sensors in the paper conveyance path 31 with an appropriate timing for the image forming section 2 to transfer the toner image. If the control section 10 determines that any of the recording paper sheets P has not reached the appropriate position with the appropriate timing, then it considers that a paper jam has occurred in the paper conveyance path 31.

If the control section 10 determines that a paper jam has occurred, then it, at this time, deactivates the main drive motor 9 to stop the operations of the above rollers and roller pairs involving the paper conveyance path 31.

Figure 3:
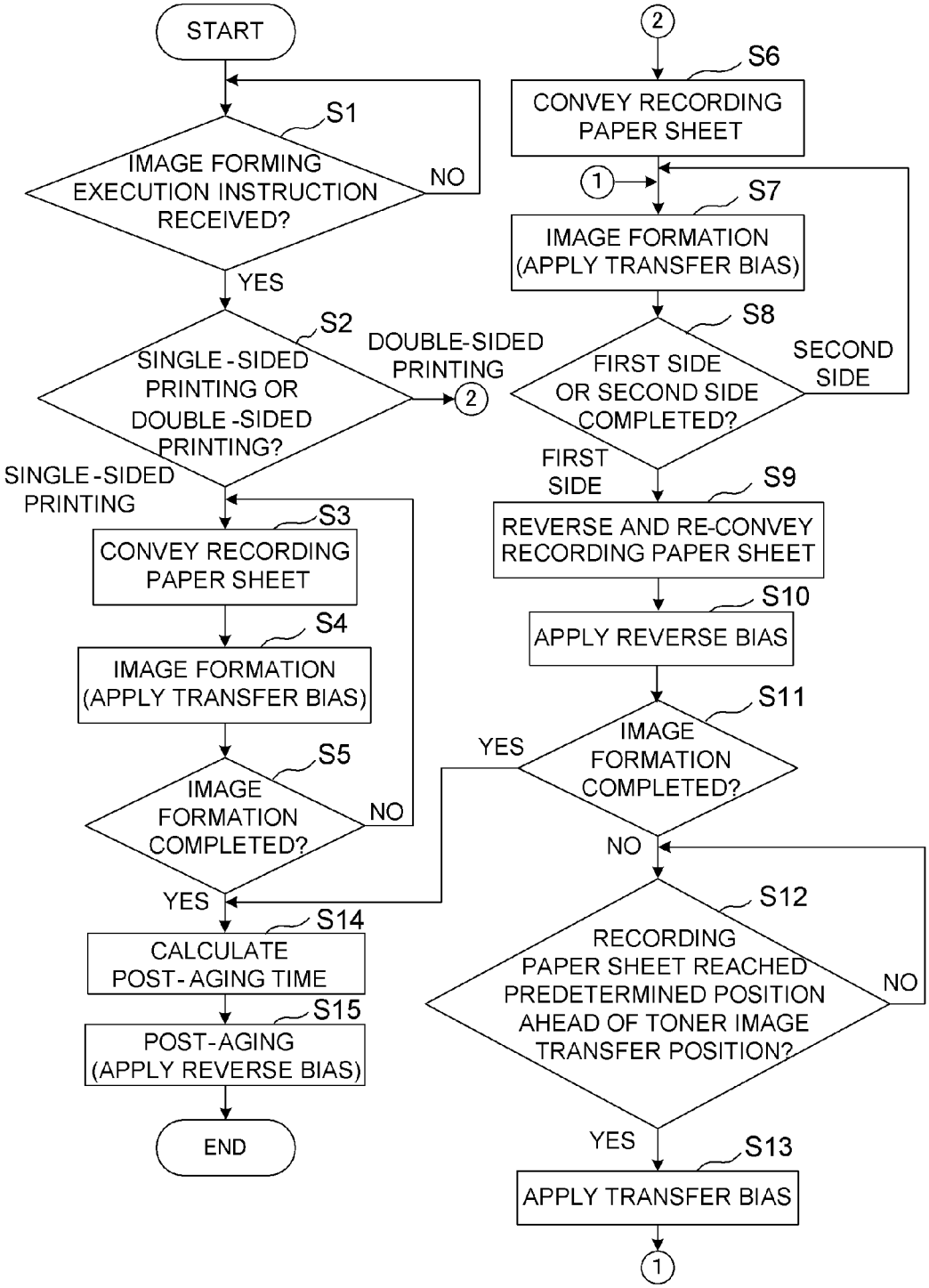
FIG. 3 is a flowchart showing a first embodiment of control of the application of bias to a transfer roller in the image forming apparatus.
Figure 4A:
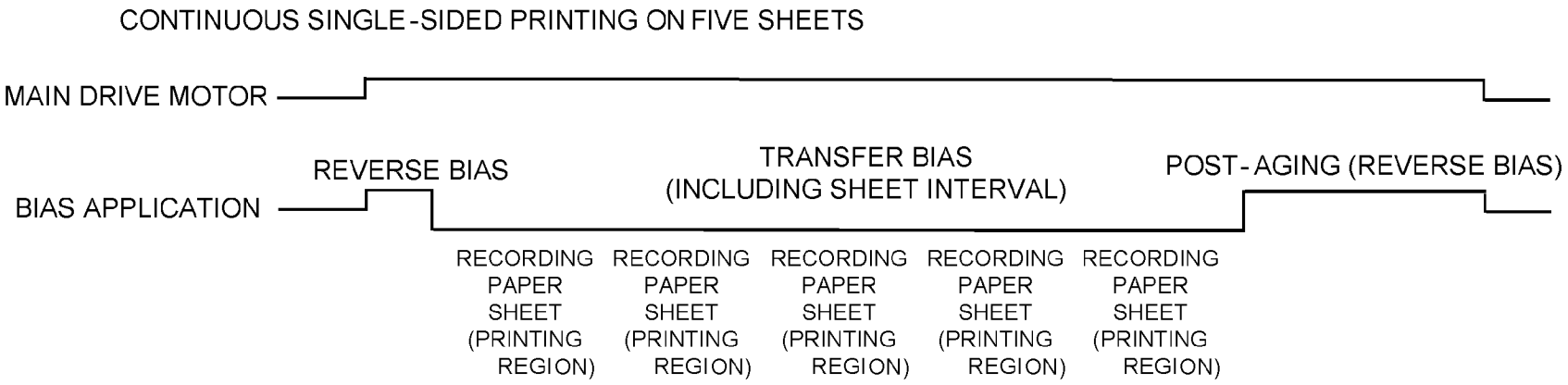
FIG. 4A is a timing chart of a main drive motor and bias application during single-sided printing.
Figure 4B:
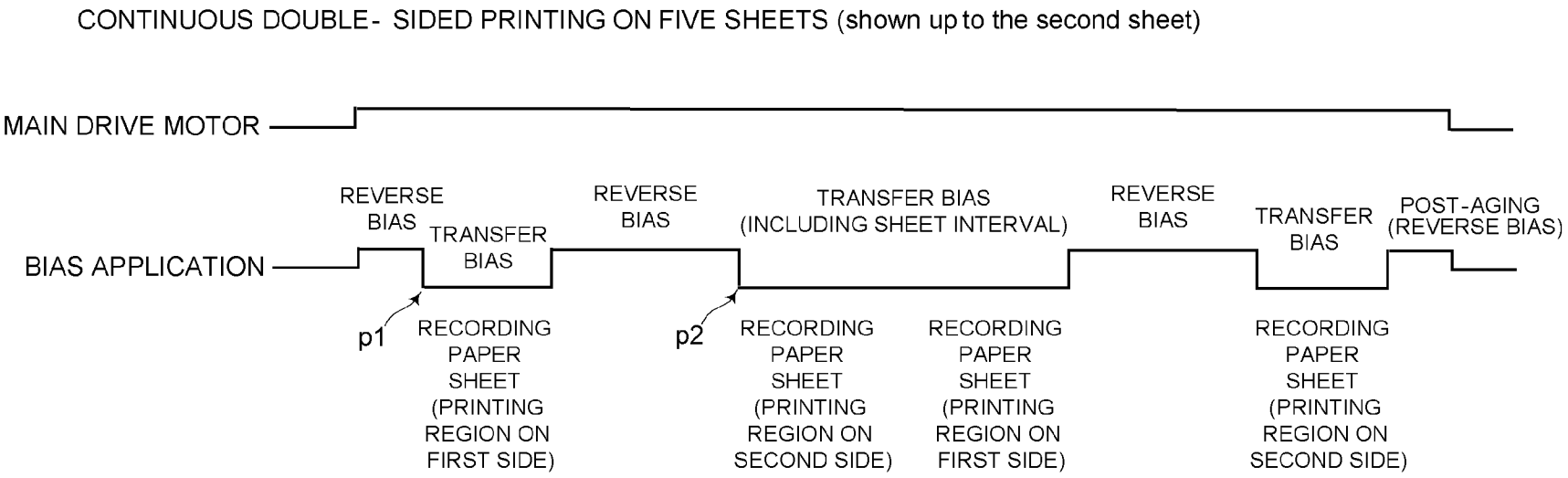
FIG. 4B is a timing chart of the main drive motor and bias application during double-sided printing.

Next, a description will be given of a first embodiment of control of the application of bias to the transfer roller 251 in the image forming apparatus 1. FIG. 3 is a flowchart showing the first embodiment of control of the application of bias to the transfer roller 251 in the image forming apparatus 1. FIG. 4A is a timing chart of the main drive motor 9 and bias application during single-sided printing and FIG. 4B is a timing chart of the main drive motor 9 and bias application during double-sided printing. This embodiment describes, as an example, the case of continuous printing for continuously forming images on a plurality of recording paper sheets.

When an image forming execution instruction is input by the operation of an operating section 47 done by an operator or a receipt of a print job from a computer connected to the control section 10 with a network and the instruction is received by the control section 10 (YES in S1), the control section 10 determines whether the printing mode specified by the image forming execution instruction is single-sided printing or double-sided printing (S2).

If the control section 10 determines that the printing mode specified by the image forming execution instruction is single-sided printing ("SINGLE-SIDED PRINTING" in S2), then it drives the main drive motor 9 to cause the paper feed roller 41 to convey recording paper sheets P one after another at regular intervals from the paper feeder 40 (S3). The conveyance of the recording paper sheets P is performed, under the control exercised by the control section 10, by the number of sheets to be printed specified by the image forming execution instruction.

Then, the control section 10 causes the image forming section 2 to start the formation of a toner image for transfer to each recording paper sheet P (image formation) so that the toner image on the surface of the photosensitive drum 21 can be transferred to the recording paper sheet P the above-mentioned predetermined time after the timing when the paper feed roller 41 has started to convey the recording paper sheet P (S4).

During the image formation, the control section 10 causes the charging of the charging roller 221 in the charging section 22, the exposure of the exposure section 23, the development of the developing section 24, and the toner image transfer of the transfer roller 251. The control section 10 causes the transfer bias applying section 25 to apply a transfer bias of reverse polarity to the charge of the toner (negative polarity) to the transfer roller 251. In this case, also in every sheet interval between the recording paper sheets P being successively conveyed to the toner image transfer position, the control section 10 causes the transfer bias applying section 25 to apply the transfer bias.

Furthermore, as shown in FIG. 4A, prior to the application of the transfer bias for the image formation, the control section 10 causes the transfer bias applying section 25 to apply a reverse bias of the same polarity as the charge of the toner (positive polarity) to the transfer roller 251 for a predetermined time. Thereafter, the control section 10 preferably causes the transfer bias applying section 25 to start the application of the transfer bias to the transfer roller 251 from a point of time p1 which is a time for one revolution of the surface of the photosensitive drum 21 (at least a time for one revolution of the surface of the photosensitive drum 21, the same shall apply hereinafter) prior to the point of time when the formation of an image on the first recording paper sheet P will be started.

Thereafter, the control section 10 determines whether or not the image formation on the number of sheets to be printed specified by the image forming execution instruction has been completed (S5). If the image formation on the number of sheets to be printed has not been completed (NO in S5), then the process goes back to S4, where the control section 10 causes the image forming operation for the next recording paper sheet to be conveyed next.

The control section 10 repeats the image forming operation for the next recording paper sheet P to be conveyed until the completion of image formation on the specified number of sheets to be printed (NO in S5 and S4). When determining that the image formation on the number of sheets to be printed specified by the image forming execution instruction has been completed (YES in S5), the control section 10 calculates the execution time for post-aging (S14) and causes the transfer bias applying section 25 and the main drive motor 9 to perform the post-aging operation (S15). The details of the calculation of the post-aging time and the post-aging operation will be described later.

The following is a description of the control of drive of the transfer bias applying section 25 exercised by the control section 10 during single-sided printing. Specifically, as shown in FIG. 4A, the control section 10, during the above-mentioned image formation, outputs a drive command signal to the main drive motor 9 and thereby causes the main drive motor 9 to rotate the paper feed roller 41 to perform the above-mentioned conveyance (S3) of the recording paper sheets P. This drive of the main drive motor 9 based on the output of the drive signal is continued until the image formation on the number of sheets to be printed (five in this example) specified by the image forming execution instruction is completed.

Furthermore, as described previously, the control section 10 causes the transfer bias applying section 25 to continue to apply the transfer bias also in every sheet interval between the recording paper sheets P being successively conveyed to the toner image transfer position.

Then, after the completion of image formation on all the recording paper sheets P specified by the image forming execution instruction, the control section 10 causes the transfer bias applying section 25 to apply a reverse bias as the above-mentioned post-aging operation.

On the other hand, if in S2 the control section 10 determines that the printing mode specified by the image forming execution instruction is double-sided printing ("DOUBLE-SIDED PRINTING" in S2), then it drives the main drive motor 9 to cause the paper feed roller 41 to sequentially convey recording paper sheets P at regular intervals from the paper feeder 40 (S6). The conveyance of the recording paper sheets P is performed in sequence, under the control exercised by the control section 10, by the number of sheets to be printed specified by the image forming execution instruction.

The control section 10 causes the image forming section 2 to start the formation of a toner image for transfer to each recording paper sheet P so that the toner image on the surface of the photosensitive drum 21 can be transferred to the recording paper sheet P the above-mentioned predetermined time after the timing when the paper feed roller 41 has started to convey the recording paper sheet P (S7). During the image formation, the control section 10 causes the transfer bias applying section 25 to apply the above-mentioned transfer bias to the transfer roller 251, thereby causing the transfer roller 251 to transfer the toner image formed on the surface of the photosensitive drum 21 to the recording paper sheet P conveyed to the toner image transfer position. This transfer of the toner image is directed to a first side of the recording paper sheet P to be subjected to double-sided printing.

As shown in FIG. 4B, the control section 10, as is the case of single-sided printing, causes the transfer bias applying section 25 to apply a reverse bias of the same polarity as the charge of the toner (positive polarity) to the transfer roller 251 for a predetermined time. Thereafter the control section 10 causes the transfer bias applying section 25 to start the application of the transfer bias to the transfer roller 251 from a point of time p1 (see FIG. 4B) which is a time for one revolution of the surface of the photosensitive drum 21 prior to the point of time when the formation of an image on a first side of the first recording paper sheet P will be started.

Thereafter, the control section 10 determines, based on the contents of the above image forming execution instruction, to which of the first and second sides of the recording paper sheet P the above image forming operation has been directed (S8). If the control section 10 determines that the above image forming operation has been directed to the first side of the recording paper sheet P ("FIRST SIDE" in S8), then it causes the conveyance roller pairs 32 and the reverse roller pair 341 to perform a reversing operation, so that the recording paper sheet P turned over after the completion of transfer of the toner image is conveyed again (re-conveyed) to the toner image transfer position (S9).

During this reversal and re-conveyance, as shown in FIG. 4B, the control section 10 causes the transfer bias applying section 25 to apply a reverse bias of the same polarity as the charge of the toner (positive polarity) to the transfer roller 251 (S10).

Thereafter, the control section 10 determines, based on the contents of the image forming execution instruction, whether or not the image formation on the specified number of sheets to be printed has been completed (S11). If the image formation on the specified number of sheets to be printed has not been completed (NO in S11), then the control section 10 causes the transfer bias applying section 25 to apply a transfer bias, instead of the above-mentioned reverse bias, to the transfer roller 251 from a point of time p2 (see FIG. 4B) which is a time t1 for one revolution of the surface of the photosensitive drum 21 prior to the point of time when the recording paper sheet P being re-conveyed will reach the toner image transfer position.

Specifically, at the time when the recording paper sheet P has been conveyed to a predetermined point upstream of the toner image transfer position in the direction of conveyance of the recording paper sheet P (where the time for movement of the recording paper sheet P from the predetermined point to the toner image transfer position is equal to the time t1) (YES in S12), the control section 10 causes the transfer bias applying section 25 to start to apply the transfer bias, instead of the reverse bias, to the transfer roller 251 (S13). For example, the control section 10 employs, as the timing (the point of time p2) to change the bias to be applied from the reverse bias to the transfer bias, (1) the point of time when the leading end of the recording paper sheet P has been detected based on a paper detection signal from the paper detecting sensor 71 or the paper detecting sensor 74 or (2) the point of time when a predetermined time has passed since the point of time (1).

Thereafter, the process goes back to S7, where the control section 10 causes the image forming section 2 to start the formation of a toner image to be transferred to the second side of the recording paper sheet P with the timing when the recording paper sheet P reaches the toner image transfer position (S7). For example, the control section 10 employs, as the timing to start the image formation, the point of time when a predetermined time has passed since the leading end of the recording paper sheet P has been detected based on a paper absence signal and a paper presence signal from the paper detecting sensor 74. During this image formation, the control section 10 causes the transfer bias applying section 25 to continue the application of the transfer bias having already been started in S13.

Then, the control section 10 determines to which of the first and second sides of the recording paper sheet P the above image forming operation has been directed (S8). If the control section 10 determines that the above image forming operation has been directed to the second side of the recording paper sheet P ("SECOND SIDE" in S8), then it causes image formation on the next and second recording paper sheet P to be conveyed to the toner image transfer position (S7).

Thereafter, the process from S7 to S13 is repeated (NO in S11) until the control section 10 determines that the image formation on the specified number of sheets to be printed has been completed. If the control section 10 determines that the image formation on the specified number of sheets to be printed has been completed (YES in S11), then it calculates the post-aging time necessary for the post-aging operation (S14) and causes the transfer bias applying section 25 and the main drive motor 9 to perform the post-aging operation (S15).

The post-aging operation is described below.

The post-aging operation is an operation conducted by the control section 10 to cause the transfer bias applying section 25 to apply the reverse bias to the transfer roller 251 after the completion of single-sided printing or double-sided printing. If the transfer bias of reverse polarity to the charge of the toner forming the toner image is always applied to the ion-conductive transfer roller (transfer roller in claim 251, ionic polarization occurs inside the transfer roller 251 to impair the electric conduction of the transfer roller 251. Therefore, after the completion of single-sided printing or double-sided printing, the post-aging operation is performed by applying a reverse bias of the same polarity as the charge of the toner from the transfer bias applying section 25 to the transfer roller 251, so that ionic polarization is reduced to prevent the deterioration (resistance rise) of the transfer roller 251. The control section 10 calculates the execution time for the post-aging according to the total time of application of transfer bias performed by the image forming apparatus 1.

In this case, the control section 10 preferably calculates the execution time for the post-aging so that the ratio of the total time of application of the reverse bias (Io) performed by the image forming apparatus 1 since its start-up to the total time of application of the transfer bias (In) performed by the image forming apparatus 1 since its start-up is ⅕ or more (i.e., the total time of application of the transfer bias (In) to the total time of application of the reverse bias (Io) is equal to or smaller than 5).

For example, the control section 10 measures, with a built-in timer, the time of application of the transfer bias (In) and the time of application of the reverse bias (Io) since the start-up of the image forming apparatus 1, calculates the total time of application of the transfer bias (In) since the start-up and the total time of application of the reverse bias (Io) since the start-up, and stores both the total times.

Upon each image forming operation, the control section 10 adds the measured time of application of the transfer bias (In) to the total time of application of the transfer bias (In) and calculates the time of application of the reverse bias for the post-aging to be performed after the completion of the current image forming operation so that the total time of application of the reverse bias (Io) is ⅕ or more of the latest total time of application of the transfer bias (In).

In this relation, the control section 10 calculates the time of application of the reverse bias for the post-aging to be performed immediately after the current image forming operation so that the total time of application of the reverse bias (Io), including the time of application of the reverse bias (S10) during reverse conveyance of the recording paper sheet P in the case of double-sided printing, is ⅕ or more of the latest total time of application of the transfer bias (In).

Figure 5:
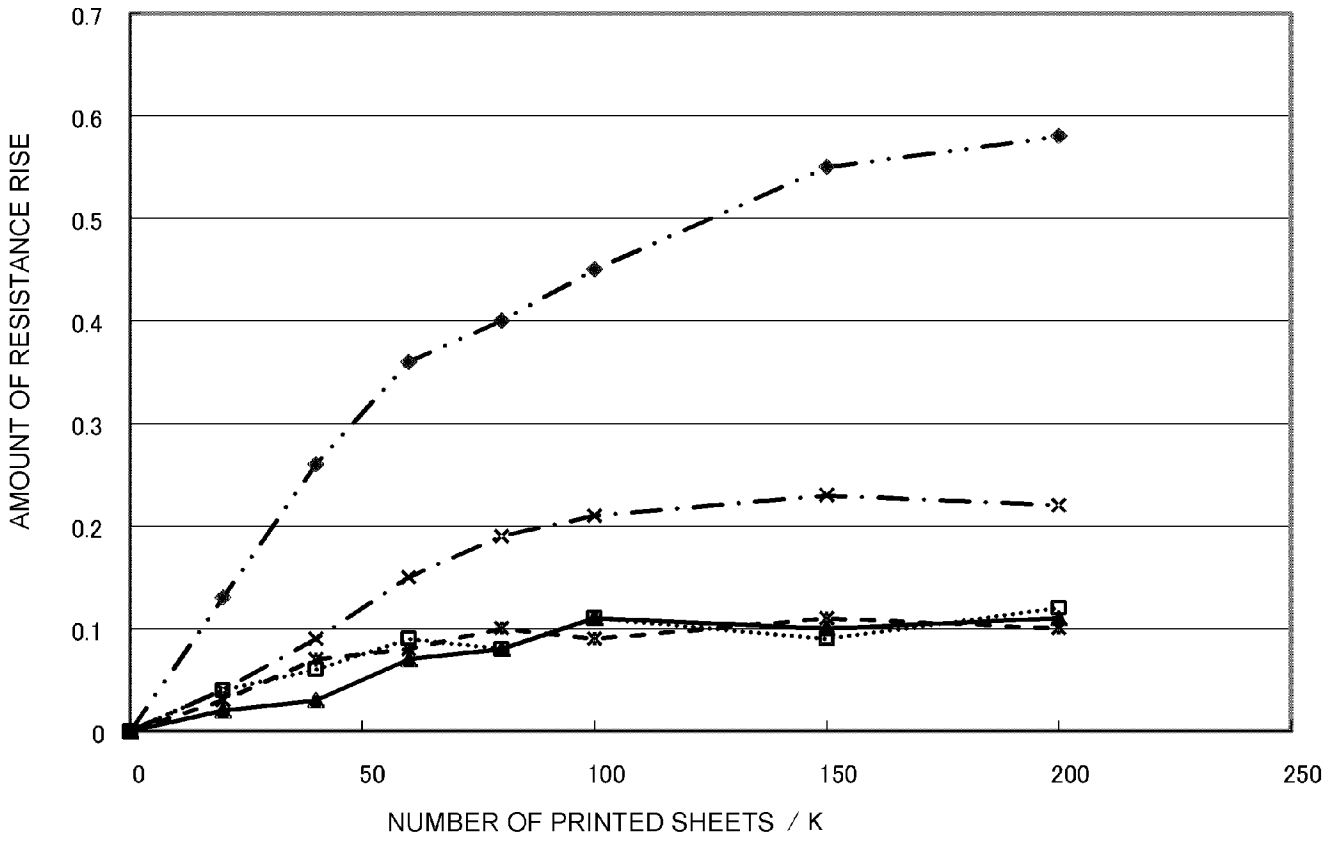
FIG. 5 is a chart graphically showing differences in amount of resistance rise of the transfer roller among various ratios of the total time of application of reverse bias to the total time of application of transfer bias.

The following is a description of differences in amount of resistance rise of the transfer roller 251 among various ratios of the total time of application of the reverse bias (Io) to the total time of application of the transfer bias (In). FIG. 5 is a graph showing differences in amount of resistance rise of the transfer roller 251 among various ratios of the total time of application of the reverse bias (Io) to the total time of application of the transfer bias (In). In the graph shown in FIG. 5, the ordinate represents the amount of resistance rise of the transfer roller 251 and the abscissa represents the number of printed sheets.

FIG. 5 includes the results of several experiments performed under the conditions of:

a linear speed of 150 mm/sec;

a number of printed sheets of 25 in terms of ppm (pages per minute); and a transfer current of −15 μA (reverse bias: +400 V), using an ion-conductive roller (ECO+NBR) manufactured by Yamauchi Corporation as the transfer roller.

For example, in an experiment in which neither the application of the reverse bias in S10 in FIG. 3 nor the post-aging was performed, as shown by the dash-double-dot line connecting the rhomboid points in FIG. 5, the amount of resistance rise significantly increased with increasing number of printed sheets, and the resistance reached near 0.6 when 200 sheets were printed.

In contrast, in an experiment in which the application of the reverse bias in S10 was performed and the post-aging was performed to compensate for the reverse bias so that the total time of application of the transfer bias (In) to the total time of application of the reverse bias (Io) was equal to 1, as shown by the dotted line connecting the square points in FIG. 5, the amount of resistance rise increasing with the number of printed sheets could be limited to about 0.1 at the time when 200 sheets were printed. Thus, suitable results could be achieved.

Alternatively, for example, also in an experiment in which the application of the reverse bias in S10 was performed and the post-aging was performed to compensate for the reverse bias so that the total time of application of the transfer bias (In) to the total time of application of the reverse bias (Io) was equal to 5, as shown by the solid line connecting the triangle points in FIG. 5, the amount of resistance rise increasing with the number of printed sheets could be limited to about 0.1 at the time when 200 sheets were printed. Thus, suitable results could be likewise achieved.

However, for example, in an experiment in which the application of the reverse bias in S10 was performed and the post-aging was performed to compensate for the reverse bias but the total time of application of the transfer bias (In) to the total time of application of the reverse bias (Io) was equal to 8, as shown by the dash-single-dot line connecting the crosses in FIG. 5, the amount of resistance rise increasing with the number of printed sheets was relatively large and the resistance reached slightly over 0.2 at the time when 200 sheets were printed.

Therefore, if the control section 10 calculates the time of application of the reverse bias for the post-aging after the completion of the image forming operation so that the total time of application of the reverse bias (Io) is ⅕ or more of the latest total time of application of the transfer bias (In), ionic polarization inside the transfer roller 251 can be efficiently reduced to surely suppress the increase in resistance.

As described previously, the control section 10 calculates the post-aging time after the addition of the time of application of the reverse bias performed in S10. Therefore, if the ratio of the total time of application of the transfer bias (In) to the total time of application of the reverse bias (Io) has already reached 5 or below at the time when the application of the reverse bias in S10 has been performed, the post-aging time is zero. In other words, in this case the control section 10 does not conduct the post-aging.

FIG. 5 further includes the results of another experiment performed under the following conditions:

The time of application of the reverse bias was composed of 2 seconds during a period from the feed of the recording paper sheet P to before the transfer of a toner image thereto; 3 seconds during a period from after the transfer of the toner image (from the end of printing) to the output of the recording paper sheet P; and, if in the case of double-sided printing, 2 seconds during a period from after the transfer of the toner image to (from the end of printing on) the first side of the recording paper sheet P to before the transfer of a toner image to the second side thereof with a reversing operation between them.

The time of application of the transfer bias (positive bias) was composed of 1.4 seconds throughout the transfer of the toner image to the recording paper sheet P; 1 second throughout every sheet interval between recording paper sheets P; and a time for one revolution of the surface of the photosensitive drum 21 prior to the start of transfer of the toner image (start of image formation).

The post-aging was executed for 5 seconds.

The linear speed was 150 mm/sec.

The number of printed sheets was 25 in terms of ppm.

A DC-biased chargeable OPC (organic photoconductor) roller (ϕ24) was used as the photosensitive drum.

An ion-conductive roller (ϕ14, resistance: $10^{7.2}$ ohm) manufactured by Yamauchi Corporation was used as the transfer roller.

The transfer current was −15 μA (reverse bias: +400 V).

In this experiment in which the application of the reverse bias in S10 and the post-aging were performed, as shown by the broken line connecting the asterisks in FIG. 5, the amount of resistance rise increasing with the number of printed sheets could be limited to about 0.1 at the time when 200 sheets were printed. Thus, suitable results could be achieved.

As described so far, in the first embodiment, in transferring a toner image using the ion-conductive transfer roller 251, the control section 10 in the case of double-sided printing causes the transfer bias applying section 25 to apply the reverse bias to the transfer roller 251 during a period of paper conveyance from the passage of the recording paper sheet P through the toner image transfer position to the completion of re-conveyance thereof to the toner image transfer position caused by the reversing operation. Thus, ionic polarization inside the transfer roller 251 can be avoided to prevent the deterioration of the transfer roller 251. Furthermore, after the application of the reverse bias to the transfer roller 251, the control section 10 causes the application of the transfer bias at least over a time of one revolution of the surface of the photosensitive drum 21 before the recording paper sheet P has been re-conveyed to the toner image transfer position. This makes it possible to perform the operation of forming a toner image to be transferred to the re-conveyed recording paper sheet P after a history of charge due to the application of the reverse bias is eliminated from the surface of the photosensitive drum 21 by the above application of the transfer bias to prevent the surface of the photosensitive drum 21 from causing surface potential differences between various portions.

In other words, in the first embodiment, both the application of the reverse bias contributing to reduction in ionic polarization and prevention of deterioration of the transfer roller and the application of the transfer bias for the avoidance of adverse effects due to the application of the above reverse bias are performed during the time for re-conveyance of the recording paper sheet P caused by the reversing operation, which is longer than each interval between a plurality of recording paper sheets P being successively conveyed to the toner image transfer position. Therefore, in transferring a toner image on the surface of the photosensitive drum 21 to the recording paper sheet P using the ion-conductive transfer roller 251, the post-aging time can be reduced while the effects of reduction in ionic polarization and prevention of deterioration of the transfer roller can be maintained.

Generally, in the case of charging the surface of the photosensitive drum 21 formed of an organic photoconductor using the contact-type charging roller 221, the above-mentioned application of the reverse bias to the transfer roller 251 is likely to cause the charge history due the application to remain on the surface of the photosensitive drum 21. However, even in such a situation, this embodiment can eliminate the charge history due to the application of the reverse bias.

Figure 6A:
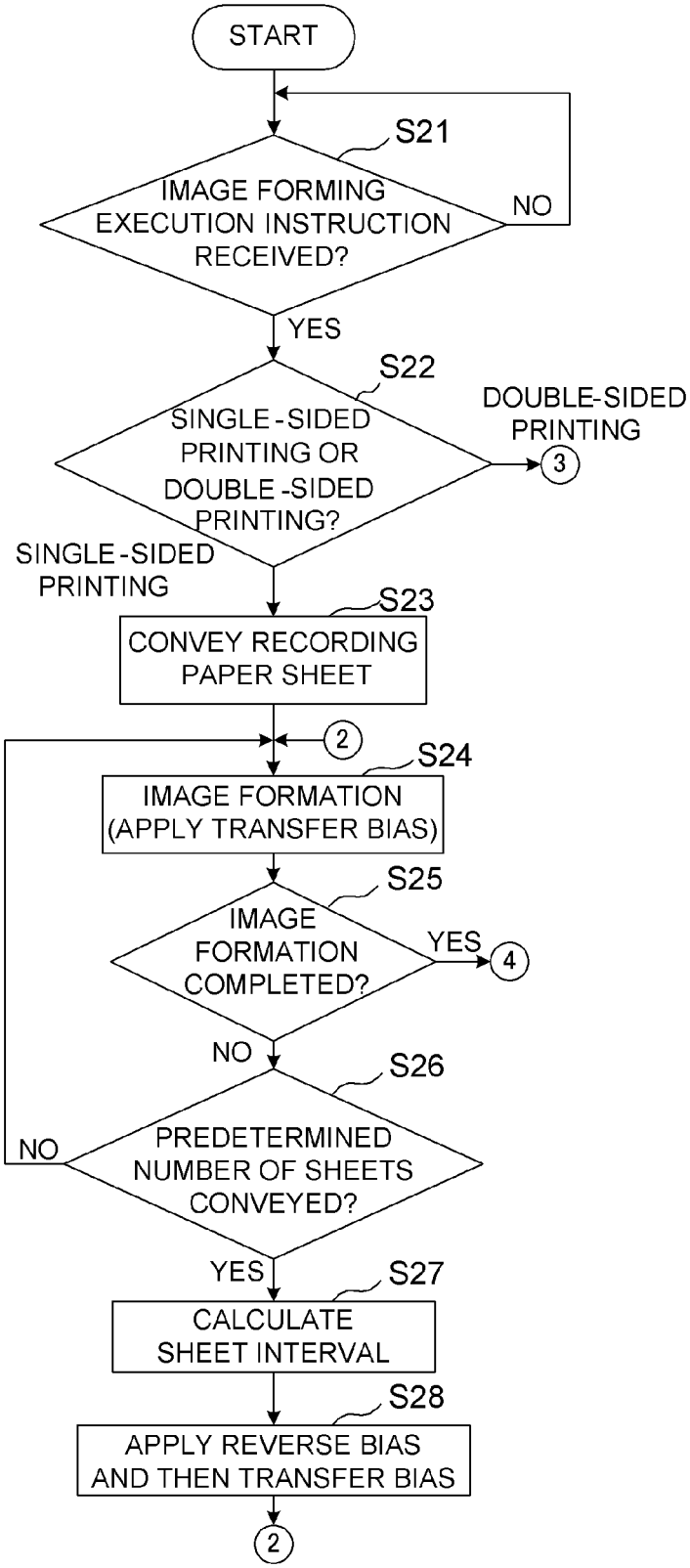
FIG. 6A and FIG. 6B are a flowchart showing a second embodiment of control of the application of bias to the transfer roller in the image forming apparatus.
Figure 6B:
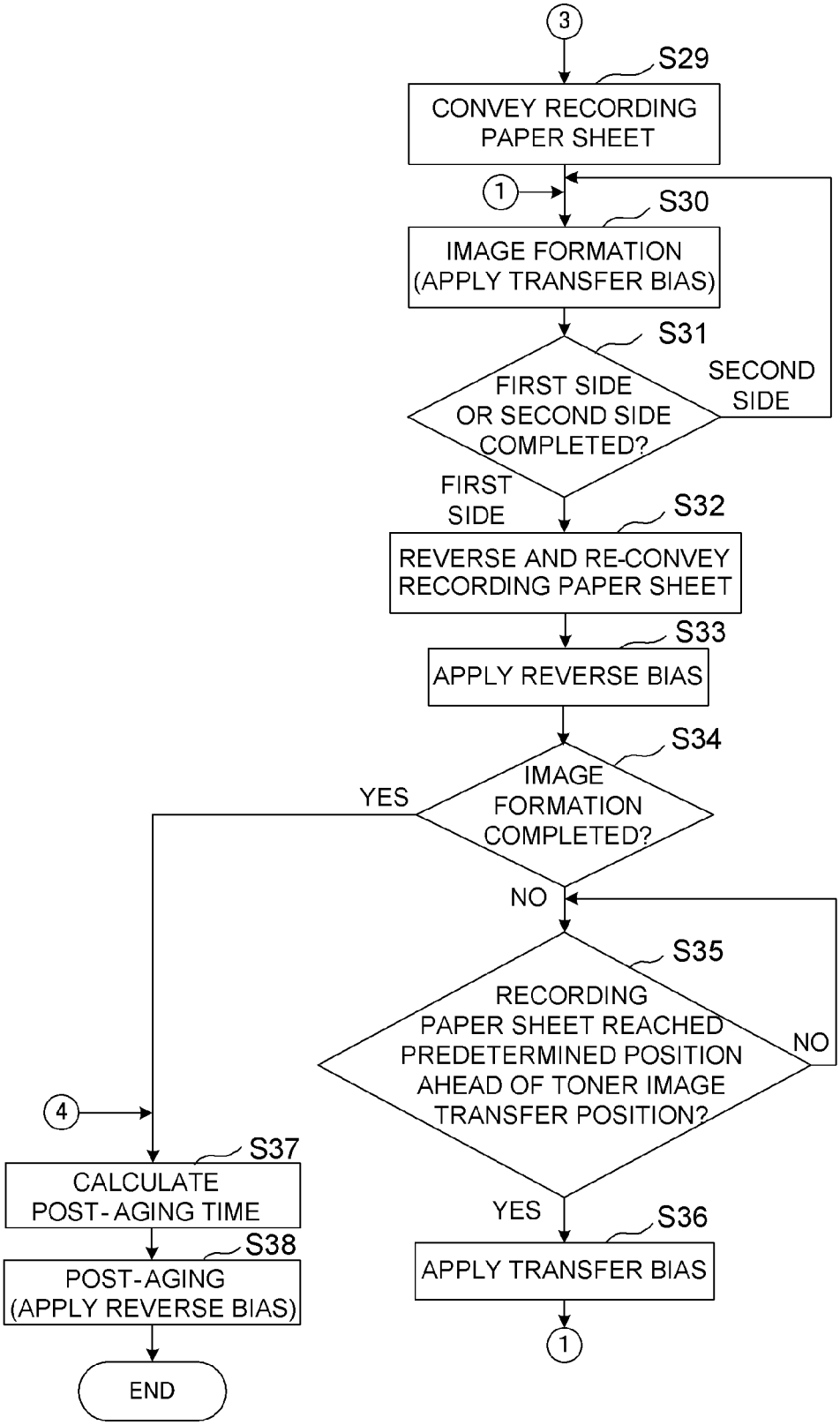

Next, a description will be given of a second embodiment of control of the application of bias to the transfer roller 251 in the image forming apparatus 1. FIG. 6A and FIG. 6B are a flowchart showing the second embodiment of control of the application of bias to the transfer roller 25 in the image forming apparatus 1. In this embodiment, the explanation of the same process steps as in the first embodiment will be omitted.

The second embodiment is different from the first embodiment in that even in the case of single-sided printing, the above-mentioned application of the reverse bias is performed during a sheet interval between recording paper sheets P being successively conveyed.

In the second embodiment, after a toner image is transferred from the surface of the photosensitive drum 21 to each recording paper sheet P conveyed to the toner image transfer position during continuous single-sided printing, the control section 10 determines whether or not the image formation on the number of sheets to be printed specified by the image forming execution instruction has been completed (S25). If the specified number of sheets to be printed has not been completed (NO in S25), then the control section 10 determines whether or not the number of recording paper sheets conveyed from the start of the current print job up to this point of time has reached a predetermined number of sheets (for example, 30) (S26). If the number of recording paper sheets conveyed up to this point of time has reached the predetermined number of sheets (YES in S26), then the control section 10 adds the time t1 necessary for one revolution of the surface of the photosensitive drum 21 to the total time of application of the transfer bias (In) at this point of time and calculates the time t2 for application of the reverse bias (Io) so that the ratio of the total time of application of the transfer bias (In) after the above addition to the total time of application of the reverse bias (Io) is equal to or smaller than 5. Then, the control section 10 calculates the time t1 plus the time t2 as the time tm representing the sheet interval between the recording paper sheet P to which the toner image has just been transferred and the next recording paper sheet P to be conveyed (S27).

After the above calculation, the control section 10 drives the main drive motor 9 with the timing of the start of the time tm representing the sheet interval between the recording paper sheet P to which the toner image has just been transferred and the next recording paper sheet P to be conveyed, thereby causing the paper feed roller 41 to start the conveyance of the next recording paper sheet P.

Furthermore, during the sheet interval tm, the control section 10 causes the transfer bias applying section 25 to first apply the reverse bias to the transfer roller 251 for only the time t2 for application of the reverse bias and then apply the transfer bias to the transfer roller 251 for only the time t1 (S28). Thereafter, the process goes back to S24 where the image formation on the next recording paper sheet P having already been started to be conveyed is performed, and then the process from S24 is repeated. The application of the transfer bias for the time t1 in S28 may be performed by starting the application of the transfer bias in S24 the time t1 ahead of the preset start point.

With the second embodiment, while adverse effects due to the application of the reverse bias can be avoided, ionic polarization inside the ion-conductive transfer roller 251 can be kept suppressed even during continuous single-sided printing.

As described in the above embodiments, the control section 10 calculates the execution time for post-aging to be performed after the completion of single-sided or double-sided printing so that the ratio of the total time of application of the reverse bias performed by the image forming apparatus 1 to the total time of application of the transfer bias performed by the image forming apparatus 1 is a predetermined ratio. In this relation, the control section 10 calculates the execution time for post-aging, even in consideration of the time of application of the reverse bias performed, in the case of double-sided printing, during a period from after the first passage of each recording medium through the toner image transfer position to before the completion of re-conveyance thereof to the toner image transfer position caused by the reversing operation. Therefore, the execution time for post-aging calculated by the control section 10 is shortened according to the exact total time of application of the reverse bias having already been performed before the calculation. Hence, the time for post-aging to be performed after the printing can be reduced and, particularly, the effect of providing a shorter time for post-aging after continuous single-sided printing on a plurality of recording media than ever before can be achieved.

The present disclosure is not limited to the configurations of the above embodiments and includes various modified forms. For example, although in the above embodiments the photosensitive drum 21 is formed of an organic photoconductor, the photosensitive layer forming the surface is composed of a single layer, and the charging roller 221 is of the type that contacts the surface of the photosensitive drum 21, they may have other structures or configurations.

Although in the above embodiments the image forming apparatus 1 according to the present disclosure is described as a printer, the image forming apparatus 1 according to the present disclosure may be an image forming apparatus of different type, such as a copier or a multifunction peripheral.

The configurations and processes illustrated by the above embodiments with reference to FIGS. 1 to 6 are merely embodiments of the present disclosure and the present disclosure is not intended to be limited to these configurations and processes.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus including:

a photosensitive drum having a surface on which an electrostatic latent image is formed while the surface rotates in a circumferential direction of the photosensitive drum;

a charging section configured to charge the surface of the photosensitive drum;

an exposure section configured to irradiate the surface of the photosensitive drum charged by the charging section with light to form the electrostatic latent image;

a developing section configured to supply toner to the electrostatic latent image formed on the surface of the photosensitive drum by the exposure section to form a toner image;

a transfer roller having ion-conductivity and configured to transfer the toner image from the surface of the photosensitive drum to a recording medium using a transfer bias;

a transfer bias applying section configured to apply to the transfer roller the transfer bias of reverse polarity to charge of the toner forming the toner image;

a conveyance section configured to, during single-sided printing, successively convey a plurality of the recording media to a toner image transfer position for transfer of the toner image located between the photosensitive drum and the transfer roller and, during double-sided printing, successively convey a plurality of the recording media by reversing the recording medium having once passed through the toner image transfer position and conveying the reversed recording medium to the toner image transfer position again; and a control section configured to, in the case of causing the conveyance section to convey the recording medium during double-sided printing, cause the transfer bias applying section to apply the transfer bias to the transfer roller while the recording medium passes through the toner image transfer position and then cause the transfer bias applying section to apply a reverse bias of the same polarity as the charge of the toner to the transfer roller during a period from the time when the recording medium has passed through the toner image transfer position to the time when the recording medium is conveyed again to the toner image transfer position after being reversed, wherein the control section performs, after the completion of the single-sided printing or the double-sided printing, post-aging to cause the transfer bias applying section to apply the reverse bias to the transfer roller and calculates an execution time for the post-aging so that the ratio of a total time of application of the reverse bias performed by the image forming apparatus to a total time of application of the transfer bias performed by the image forming apparatus is a predetermined ratio.

2. The image forming apparatus according to claim 1, wherein the control section causes the transfer bias applying section to apply the transfer bias at least over a time for one revolution of the surface of the photosensitive drum before the start of a toner image forming operation for transferring a toner image to the recording medium conveyed again to the toner image transfer position during the double-sided printing.

3. The image forming apparatus according to claim 1, wherein the control section calculates the execution time for the post-aging so that the ratio of the total time of application of the reverse bias to the total time of application of the transfer bias is equal to or larger than one-fifth.

4. The image forming apparatus according to claim 1, wherein in the case of causing the conveyance section to successively convey the recording media during the single-sided printing, the control section causes the conveyance section to extend a conveyance interval between the recording media after every conveyance of a predetermined number of the recording media, causes the transfer bias applying section to apply the reverse bias to the transfer roller during the extended conveyance interval between the recording media, and calculates a time of application of the reverse bias during the extended conveyance interval so that the ratio of the total time of application of the reverse bias to the total time of application of the transfer bias is equal to or larger than one-fifth.

5. The image forming apparatus according to claim 4, wherein the control section calculates the conveyance interval between the recording media to be extended after every conveyance of the predetermined number of the recording media as a time by adding a transfer bias application time for one revolution of the surface of the photosensitive drum to the calculated time of application of the reverse bias, and the control section causes the transfer bias applying section to apply the transfer bias over the transfer bias application time within the extended conveyance interval between the recording media.

6. The image forming apparatus according to claim 1, wherein the photosensitive drum is formed of an organic photoconductor and a photosensitive layer forming a surface thereof is composed of a single layer, and the charging section includes a charging roller in contact with the surface of the photosensitive drum and the charging roller is configured to positively charge the surface of the photosensitive drum.

* * * * *